US005861810A

United States Patent [19]

Nguyen

[11] Patent Number: 5,861,810

[45] Date of Patent: Jan. 19, 1999

[54] SYSTEM AND METHOD FOR PROVIDING CRIME VICTIMS UPDATED INFORMATION AND EMERGENCY ALERT NOTICES

[76] Inventor: Yung T. Nguyen, 8300 Winter Hill Ct., Louisville, Ky. 40299

[21] Appl. No.: 722,359

[22] Filed: Sep. 27, 1996

[51] Int. Cl.[6] ..... G08B 23/00

[52] U.S. Cl. ..... 340/573; 340/534; 340/825.36; 379/38; 379/39

[58] Field of Search ..... 340/573, 539, 340/540, 870.18, 825.36, 534; 379/38, 39, 106.1

[56] References Cited

U.S. PATENT DOCUMENTS

| | | | |
|---|---|---|---|
| 3,810,096 | 5/1974 | Kabat et al. | 340/534 |
| 4,455,548 | 6/1984 | Burnett | 340/825.36 |
| 4,980,671 | 12/1990 | McCurdy | 340/573 |
| 5,091,930 | 2/1992 | Shapiro | 379/39 |
| 5,153,584 | 10/1992 | Engira | 340/870.18 |
| 5,170,426 | 12/1992 | D'Alessio et al. | 340/573 |
| 5,266,944 | 11/1993 | Carroll et al. | 340/825.36 |
| 5,307,053 | 4/1994 | Wills et al. | 340/573 |
| 5,396,227 | 3/1995 | Carroll et al. | 340/825.36 |
| 5,402,469 | 3/1995 | Hopper et al. | 379/38 |
| 5,461,390 | 10/1995 | Hoshen | 342/419 |
| 5,534,851 | 7/1996 | Russek | 340/573 |

*Primary Examiner*—Jeffery A. Hofsass
*Assistant Examiner*—John Tweel, Jr.

[57] ABSTRACT

A system and method for communicating information concerning the status of inmates to callers and automatically notify victims registered with the system at a registered electronic address when the status of a specified inmate has changed. The notifications to the electronic address of the registered victim will continue at spaced predetermined intervals until either the registered victim responds with a registered personal identification number or a predetermined time period measured from the initial time notification elapses.

38 Claims, 13 Drawing Sheets

TYPICAL INMATE FILE

46

| |
|---|
| INMATE ID |
| INMATE LAST NAME |
| INMATE FIRST NAME |
| INMATE MIDDLE NAME |
| INMATE LOCATION |
| INMATE CUSTODY STATUS |
| INMATE RACE |
| INMATE SOC SEC NO |
| INMATE RELEASE DATE |
| INMATE REASON FOR RELEASE |

TYPICAL VICTIM FILE

48

| |
|---|
| VICTIM ID |
| VICTIM LAST NAME |
| VICTIM FIRST NAME |
| VICTIM ADDRESS 1 |
| VICTIM ADDRESS 2 |
| VICTIM PHONE 1 |
| VICTIM PHONE 2 |
| VICTIM PIN CODE |
| VICTIM INMATE ID |

TYPICAL AUDIT FILE

50

| |
|---|
| CALL DATE |
| CALL TIME |
| CALL LENGTH |
| CALL NUMBER |
| CALL RESULT |

FIG. 5

SYSTEM AND METHOD FOR PROVIDING CRIME VICTIMS UPDATED INFORMATION AND EMERGENCY ALERT NOTICES

BACKGROUND OF THE INVENTION

The present invention relates to a system and method for the alerting of victims of the change of status of a defendant in the criminal justice system.

The rights of victims in the criminal justice system is receiving considerable attention today in the midst of a significant violent crime rate and early release of many offenders due to the over crowding of prisons. Many states have passed legislation enacting the right of victims to be alerted to the early release or other changes in status of defendants and mandating that the state justice system timely notify the victims of such change in status. The system for notification has been difficult to implement for various reasons. Victims are extremely mobile and difficult to locate, requiring considerable personal effort and consequential outlay of expenses in a time of governmental budgetary limitations. Moreover, because such systems involve numerous status changes and the notification effort of busy personnel, they are highly prone to error, miscommunications and complete oversight. Most "home grown" systems have proven to be ineffective and the governmental agencies often involved make little or no effort to call victims. The failed approaches result in victims being forced to make repeated and, in many instances unsuccessful, calls to the appropriated agencies to receive status changes. The mental stress and trauma to victims caused by the failed systems can be significant coupled with a high potential of injurious attacks perpetrated by certain vindicative defendants.

It is therefore a primary object of the present invention to provide for an effective and dependable system for the timely notification of victims of a change of judicial status of defendants.

It is still another object of the present invention to provide for a victim notification system that verifies that the recipient of a notification is the victim.

It is still a further object of the present invention to provide for a victim notification system that is flexible and expandable to satisfy a wide variety of options, laws and regulations of different localities.

It is yet another object of the present invention to provide for a victim notification system that is economically affordable and technological accessible to all communities, particularly to communities of small populations.

SUMMARY OF THE INVENTION

The present invention comprises a victim notification system and method for notifying a victim of the change of status of an inmate associated with the victim. The system itself includes a central processor or control station for storing in a data base information pertaining to a plurality of prison inmates and a plurality of victims. Each of the victims in the central processor data base is identified with a respective one of the inmates and has selected a personal identification number, i.e., a "PIN". Another component of the system is a remote data storage device that receives all information pertaining to changes of status of the inmates from a computer where the information is originated. The remote data storage device communicates any inmate change of status to the central control station. Each of the victims registered in the system has a communication receiving device such as telephone for receiving changes of relevant inmate status information from the central control station. When the control station receives a change of inmate status deemed relevant, it automatically calls and informs the victim of the change. The victim then provides the PIN to confirm receipt of the notification. If the PIN is not correctly entered into the system, the system will continue to call back until the PIN is entered or a predetermined time period has elapsed.

The remote devices constantly poll the host computers to determine if any change of inmate status has occurred. All such information is uploaded to the remote device and communicated to the central control station. In this manner the information on inmates is kept current at the central control station.

To ensure that the remote data storage devices are in proper working order, each of the devices calls the central control station at predetermined time intervals. Should one of the remote devices fail to call in by the end of the predetermined time interval, an alarm and/or pager is activated so that assigned workers can immediately address the problem.

BRIEF DESCRIPTION OF THE DRAWING

FIG. 5 is chart representing typical data base record for stored information pertaining to prisoners, victims and system audit records;

DETAILED DESCRIPTION OF THE PREFERRED EMBODIMENT

In the following description, reference will be made to Callers and Registered Victims in various situations. For a clearer understanding, "Caller" shall be defined as any person that calls the system for information about the status of an inmate. "Registered Victim" shall be any person who has provided the system with his or her unique identifying communication address such as a telephone number or electronic address and selected a personal identifying number, i.e., a "PIN".

Figure 1:
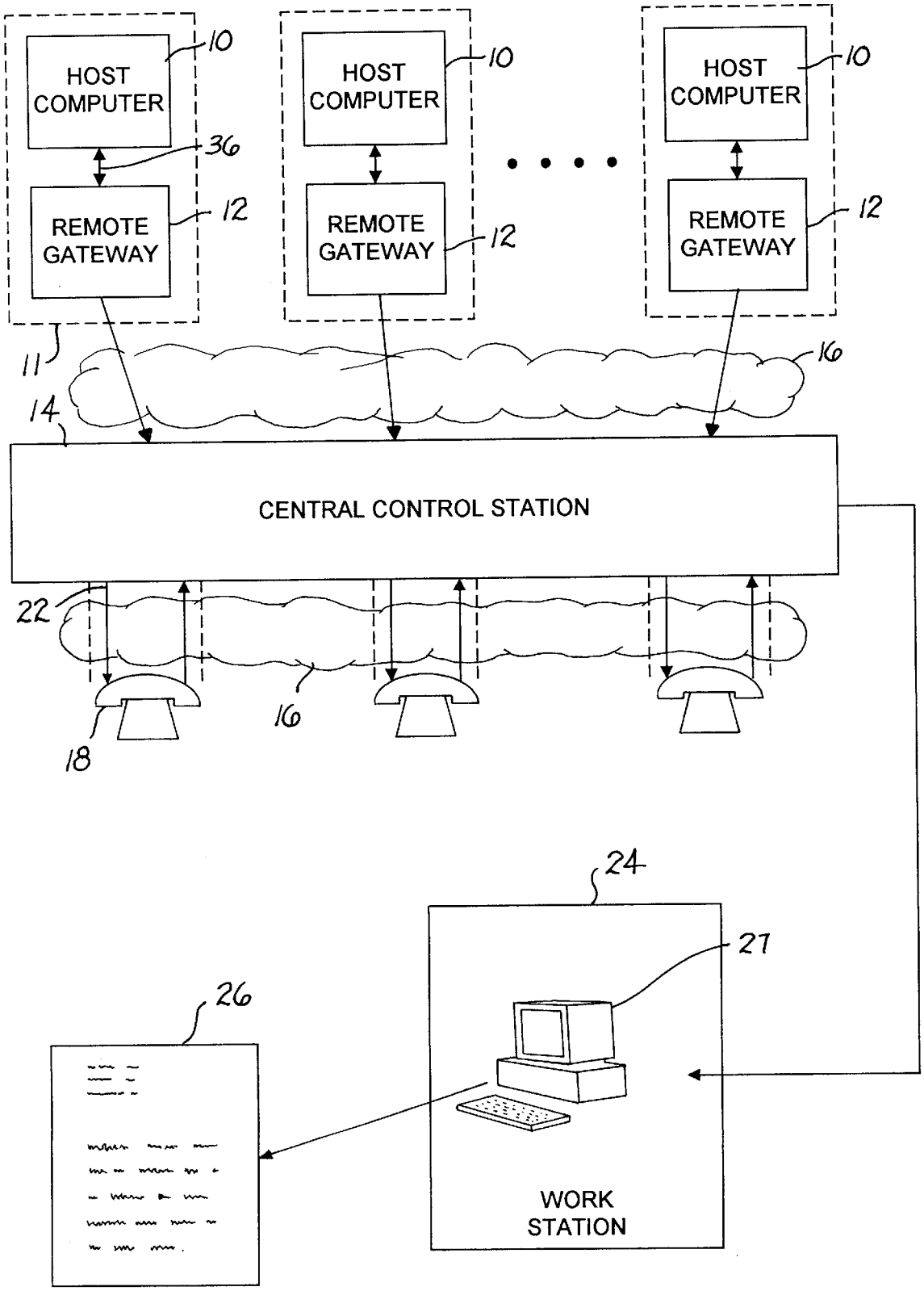
FIG. 1 is a schematic of a typical configuration and architecture of a system of victim notification in accordance with one embodiment of the present invention.
Figure 1A:
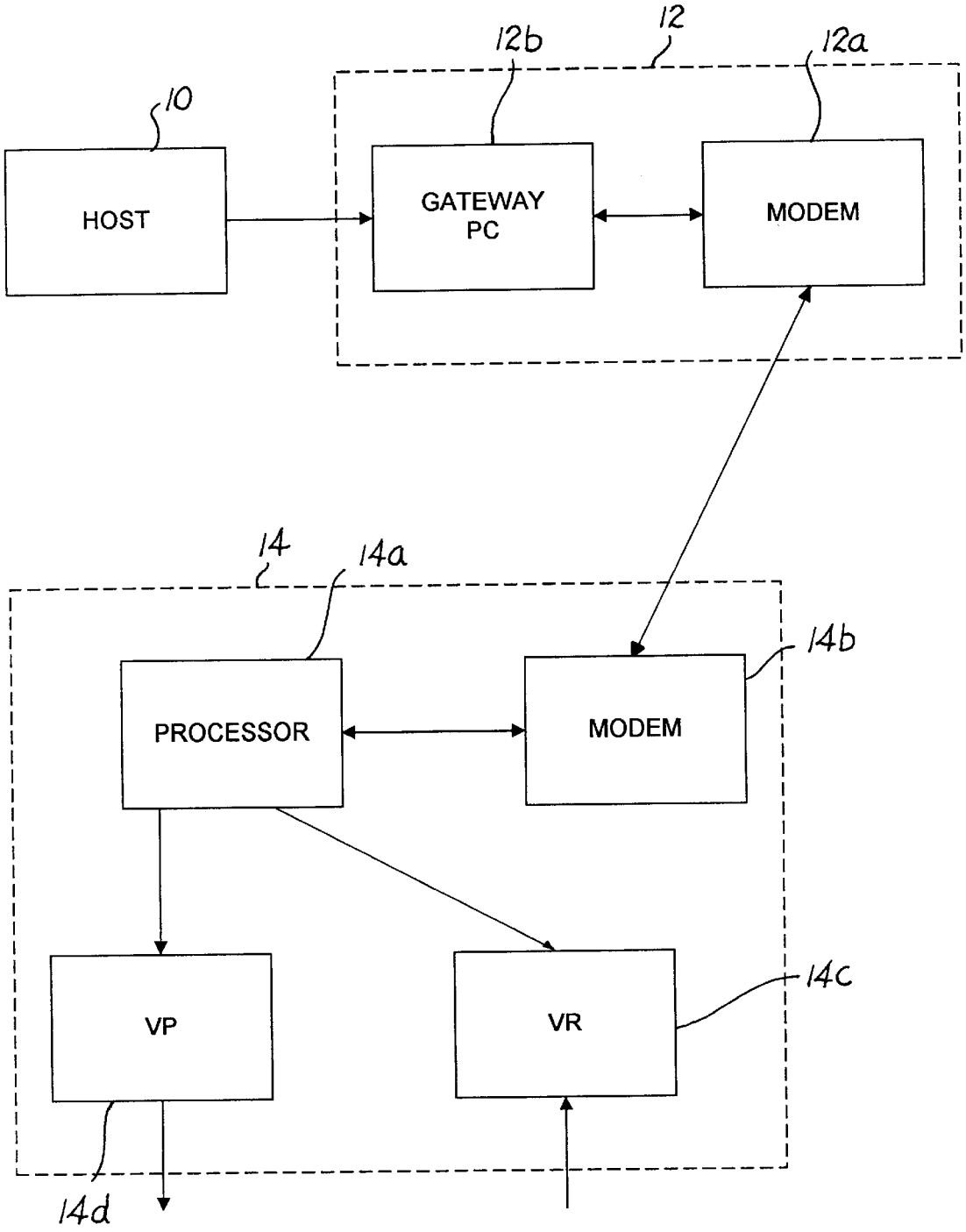
FIG. 1A is a block diagram of the major components of the central victim notification control station and remote gateway in accordance with one embodiment of the present invention.

Reference is first made to FIGS. 1 and 1A illustrating, respectively, a schematic of the victim information and notification system ("System") used to register and notify Registered Victims and a schematic of the major components of the remote gateway and central control station. The System is comprised of four major components: a plurality of host computers 10; a plurality of remote gateways 12 associated with each host computer 10; a central victim call control station 14; and a plurality of notification receiving devices such as telephones 18 associated with each Caller or Registered Victim. The host computers 10 are physically located in the region or locality of the site shown by the dashed lines 11 in which the inmates are incarcerated or placed. Such localities shall define the term "Local Site" as used in this description. Computers 10 thus generally store inmate and case management information pertaining to inmates in the respective Local Site. Examples of host computers are mainframes such as IBM 3090, Unisys or HP mainframes although at some smaller facilities a PC based system may be employed. The controlling software component used in a Local Site that tracks inmates through the local criminal justice system is ordinarily chosen by the agency in charge of managing the information ("Local Authorities"). Typically, the Local Authorities will determine the precise wording of information to be delivered to Callers and Registered Victims pertaining to inmates in the Local Site and the nature of the responses required of such Callers and Registered Users. As will be discussed below, the host computers 10 of the Local Sites are coupled via a local area network 36 to associated remote gateways 12 typically located in the same Local Site. Gateways 12 are primarily used to extract and filter the necessary information from the host computers 10 to deliver to the central control station 14 in a manner to be described. Each remote gateway 12 comprises hardware components such as a PC, a high speed modem and connection hardware as illustrated in FIG. 1A. The software component of the gateway 12 is responsive to provide the necessary information and calls needed by the central victim call control station 14.

Control station 14 communicates with remote gateway 12 through long distance network 16 and houses the central processing software functioning to process the data forwarded by remote gateways 12 from host computers 10. The primary functions of control station 14 are to process incoming calls 20 from telephones 18 and provide information in response to such calls via the long distance network 16 and to initiate warning or notification calls 22 to the numbers or electronic addresses of telephones 18 or other communication receiving devices of Registered Victims as significant changes in inmate status information is received.

As illustrated in FIG. 1A, each control station 14 typically comprises one or more central processors 14*a,* a high speed modem 14*b,* a voice recognition board 14*c,* and a telecommunication and voice processing board 14*d.* Examples of each are given in the Table 1 set forth below. As will be discussed below, the voice processing board 14*d* provides the System the ability to deliver predetermined spoken messages to registered victims while the voice recognition board provides the System the ability to process and to react to spoken commands and/or store spoken information where the Local Authorities have requested this ability as a part of the service to the Local Site.

The System of the present invention also contemplates the use of a notification work station 24 comprising a PC and software permitting operators of the System to directly use the control station 14 to generate various reports and letters. For example, letters 26 prepared, for example, by operators of PCs 27 networked with the central control station 14. Such letters are backup notices containing information with respect to the notification attempts such as when and how many notification calls were made and the notification message itself. The letters are then posted the Registered Victims who were not confirmed as being reached.

Figure 2:
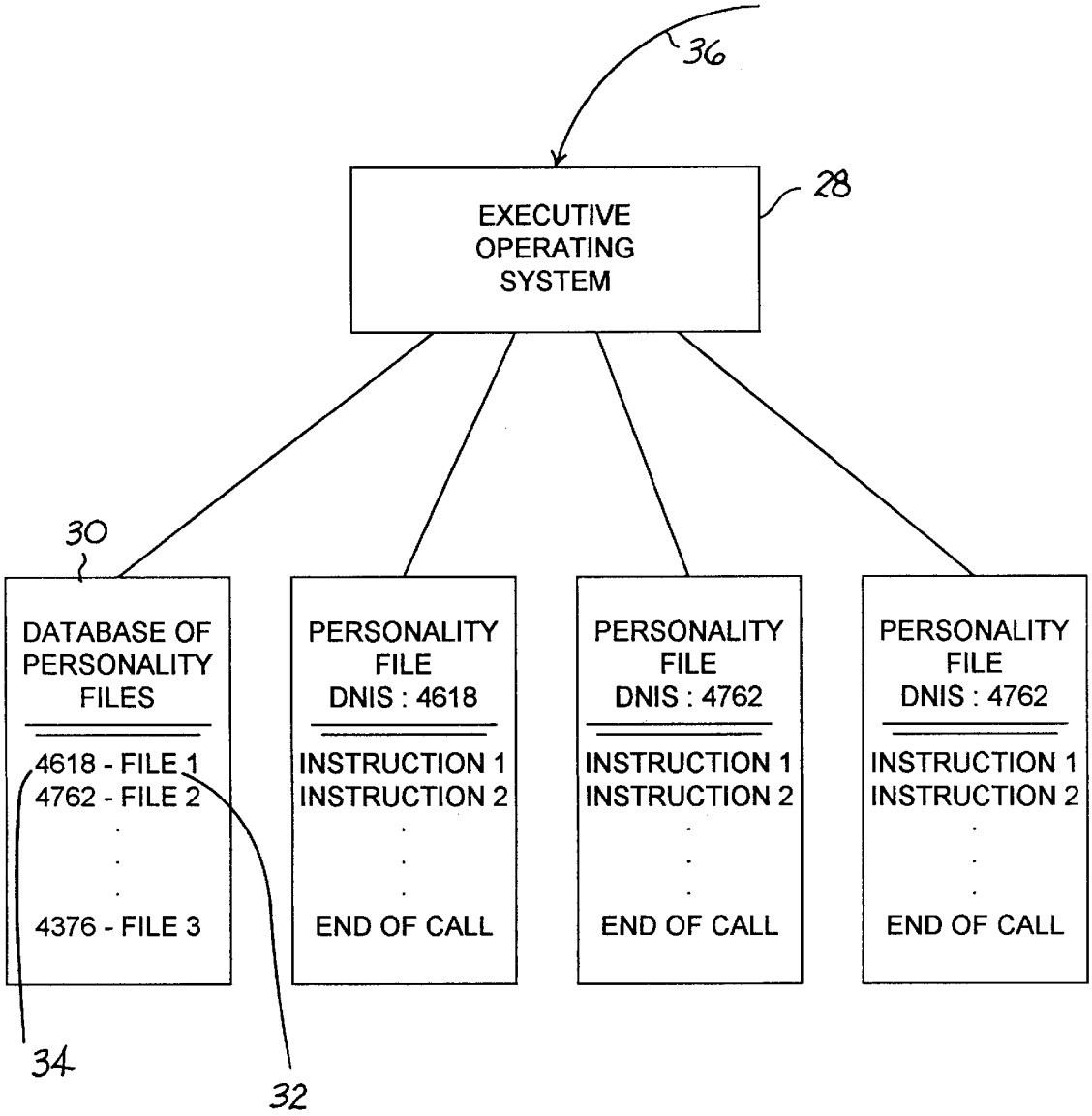
FIG. 2 is a block diagram of the executive operating system architecture.

As illustrated generally in FIG. 2, the executive operating system 28 maintains within control station 14 a comprehensive database for each Local Site represented by a "DNIS" (defined below) as character numeral 30 and "personality" files 32 for each site. The term "personality" is used to denote that each Local Site has an overall process or communication routine customized in accordance with the desires of the Local Authorities for communication with Callers and Registered Victims about victims incarcerated within the Local Site. Thus, voice messages, prompts, PIN numbers, use of voice recognition and voice inputs, and the like vary among the various Local Sites in the System. The executive operating system 28 is responsible for the management of all calls, database management, collection of remote gate way information, the personality and flow of all incoming and outgoing telephone calls, and the recording of all audit files showing incoming and outgoing call activity. When an incoming call is received, the executive operating system 28 determines the Local Site to which the incoming call pertains. All Local Sites, for example, may be assigned a specific 800number for Callers to use when requesting status information about an inmate associated with the Local Site. When a 800 number is dialed, the long distance carriers send a special code to the receiving party which identifies the specific 800 number being dialed. This service is called the Dialed Number Identification Service or "DNIS". Such a service provides receiving parties, who have purchased the use of a plurality of 800 numbers, the ability to determine which of the 800 numbers is being called. When the 800 number assigned to a particular Local Site is called, the operating system 28, using the DNIS, is prompted to locate the appropriate personality file 32 for that call. System 28 then begins executing the located personality file 32, which defines all the messages that are played during the particular call. The personality file 32 also defines all of 10 the menu selections given the Caller and reads/write the various data bases used for the call.

TABLE 1

| REMOTE GATEWAYS 12 | |
|---|---|
| PC | Pentium PC with 8 MB Ram available from Dell Computers Corp. |
| Modem | 28.8 KB HS internal modem available from US Robotics as Model Sportster |

TABLE 1-continued

| CENTRAL CONTROL STATION 14 | |
|---|---|
| Central Processor 14a | 14 Slot Pentium industrial grade rack mount central processor available from Texas Micro |
| High Speed Modem 14b | 28.8 KB HS internal modem available from US Robotics as Model Sportster |
| Voice Recognition Board 14c | Voice recognition board available from Dialogic Corp. Mfg. # VR/160 |
| Voice Processing Board 14d | T1 telecommunications and voice processing board available from Dialogic Corp. as Mfg # D/240SC-T1 |

Figure 3:
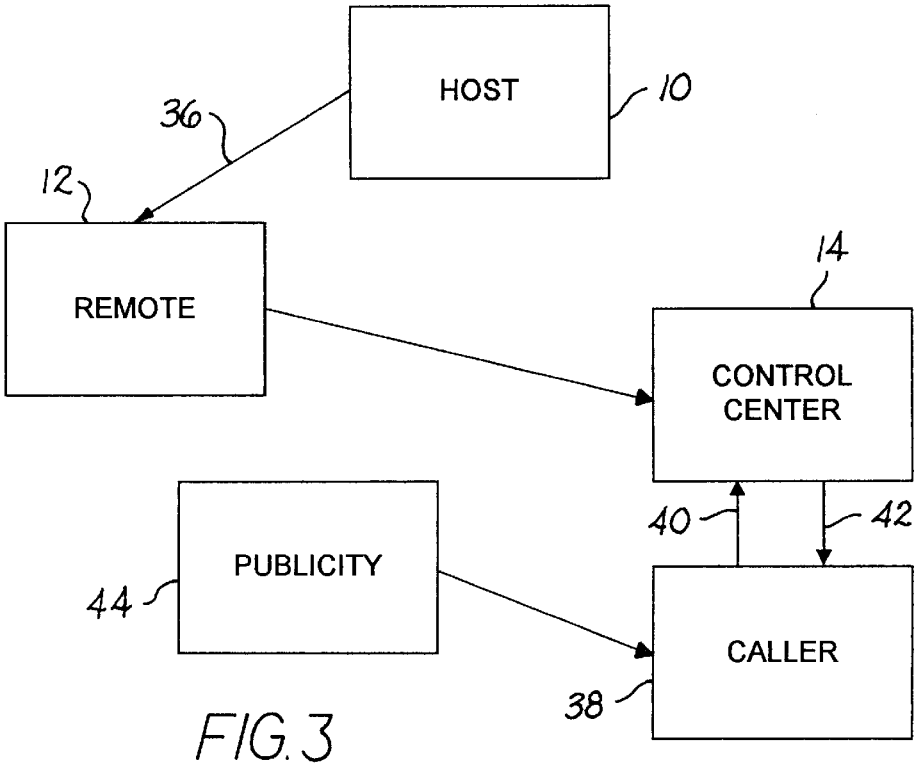
FIG. 3 is a block diagram illustrating the flow of information and signals when initially connecting the system with a remote gateway at a new location.

The inmate information that goes into the various databases is initially collected from the host computer 10 by the remote gateway 12 which, in part, comprises a PC and a high speed modem. The block diagram of FIG. 3 illustrates that, as each new Local Site goes into the System of the present invention, the PC of the remote gateway 12 associated with the new Local Site is connected through a local area network 36 to the associated host computer 10 and, as stated above, is able to communicate with the central control station 14 through a long distance carrier. Once connected, the remote gateway 12 then collects a complete set of initial inmate and victim data from host computer 10 and transmits the data to the control station 14. It is at this point that Callers (here depicted by BLOCK 38) can dial a unique 800 number (shown by character numeral 40) assigned to each Local Site and search the data bases associated with that Local Site for information on inmate status. Additionally, the Caller, if not already registered, can register as a Registered Victim for automatic notification in response to the registration request 42 communicated to the caller following delivery of the inmate status information. Individuals are made aware of the 800 number through public service announcements made in the media of the appropriate Local Site, brochures promulgated by the police of the Local Site, and other publicity as determined by the Local Authorities. This publicity transaction is depicted by publicity BLOCK 44. It should also be understood that registration of victims as Registered Victims is often done during or following the court proceedings of the inmates usually at the request of representatives of the Local Authorities. In many instances, the Local Authorities prefer to limit the availability of the System, both for search and registration operations, to those who are specifically sought out and registered by the local law enforcement personnel as opposed to allowing any person from the general public to use the System. In such case, the information pertaining to the Registered Victims is entered into the host computer 10 by representatives of the Local Authorities and, via the associated remote gateway 12, is delivered and stored in the central control station 14. Changes to the Registered Victims database can be inputted by a keyboard directly into the host computer 10 by authorized representatives of the Local Authorities and/or Registered Victims or made by the Registered Victim through direct electronic communication with the central control station 14 using the Registered Victim's telephone.

Figure 4:
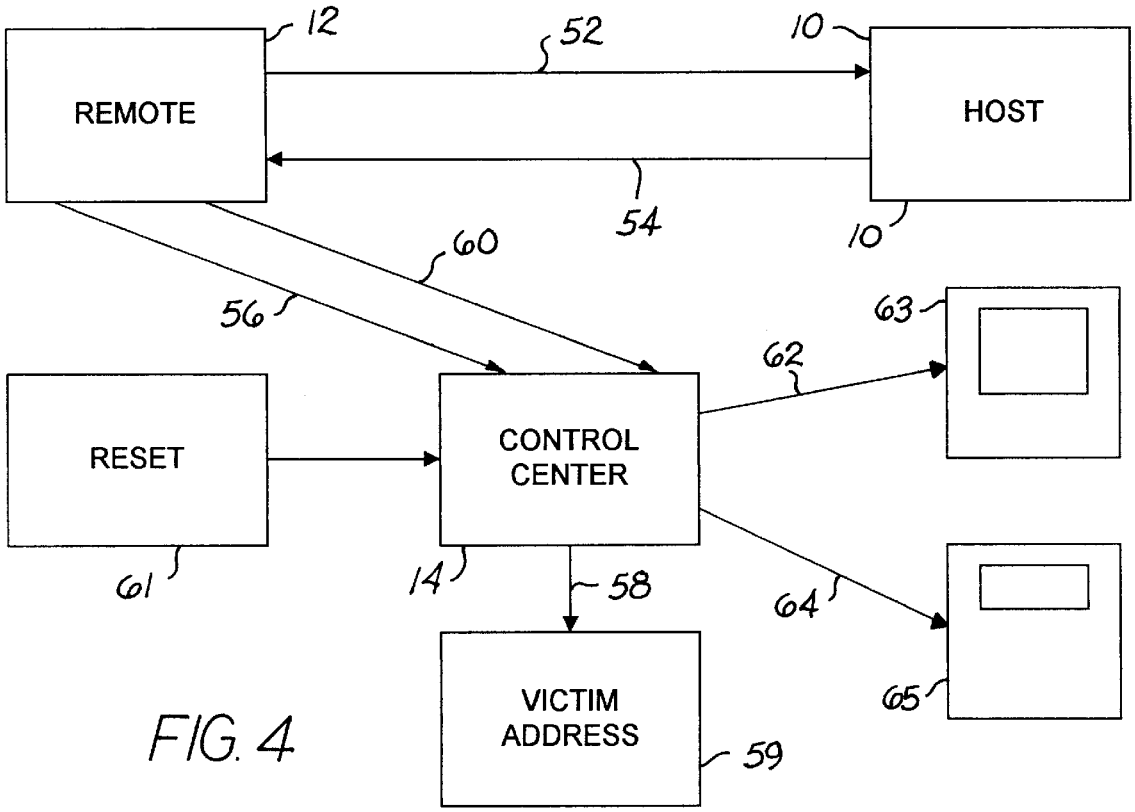
FIG. 4 is block diagram illustrating the general flow of information and signals between the various parts of the system for updates on inmate status and monitoring of remote equipment.

It is clearly imperative that the inmate databases at the central control station 14 be maintained current with quick updates reflecting any changes in inmate status. Reference is made to FIGS. 4 and 5 for the ensuing discussion, the latter Figure illustrating a typical inmate file 46, victim file 48, and audit file 50. To ensure the current state of the inmate files, remote gateway 12 makes a transaction file check 52 at predetermined intervals, e.g., every 10 minutes, with each host computer 10. As each inmate record is modified and entered into the host computer 10, the host computer 10 writes an audit record to a transaction file and uploads the transaction file depicted by line 54 to gateway 12. In turn, gateway 12 checks the transaction file for changes in inmate status. When a change is detected, gateway 12 sends the changed status depicted by line 56 to control station 14. Control station 14 then searches databases to determine if there are any Registered Victims (denoted by BLOCK 59) that need to be notified of the changed status. In the event that such Registered Victims are identified, the notification call process (discussed below) will be automatically triggered and a notification call sequence 58 initiated.

To ensure that all remote equipment is working properly and particularly that no communication lapses are occurring, each remote gateway 12 transmits a "handshake" signal 60 at frequent intervals, e.g., every two minutes, to control station 14. Preferably, the signal 60 is a telephone call to a specific telephone number at control station 14 with the call carrying an automatic number identification (ANI) signal passed between telephone rings. Such ANI signals enable the control station 14 to identify the precise remote gateway 12 making the call without making a direct connection, i.e., picking up the telephone or using separate communication channels. Some telephone carriers still do not have this capability, however. In such cases, the remote gateway 12 in the Local Site is assigned a 800 number unique for that Local Site to call and the control station 14, using the DNIS, can then identify the calling remote gateway 12 by the 800 number thus being called. When the handshake signal is timely received, the control station 14 "knows" that the gateway 12 is operating properly and the timer for that remote gateway is reset as shown by reset BLOCK 61. When a gateway 12 fails to call in with the handshake signal 60, the control station may cause an alert signal 62 to trigger an alert window of a computer screen 63 at the site of the central control station 14 alerting a viewer of the possible communication malfunction. Additionally, the control station 14 may also send out a pager signal 64 to a pager 65, alerting an assigned repair operator of the uncommunicative remote gateway who then determines the nature and addresses the problem.

Figure 6:
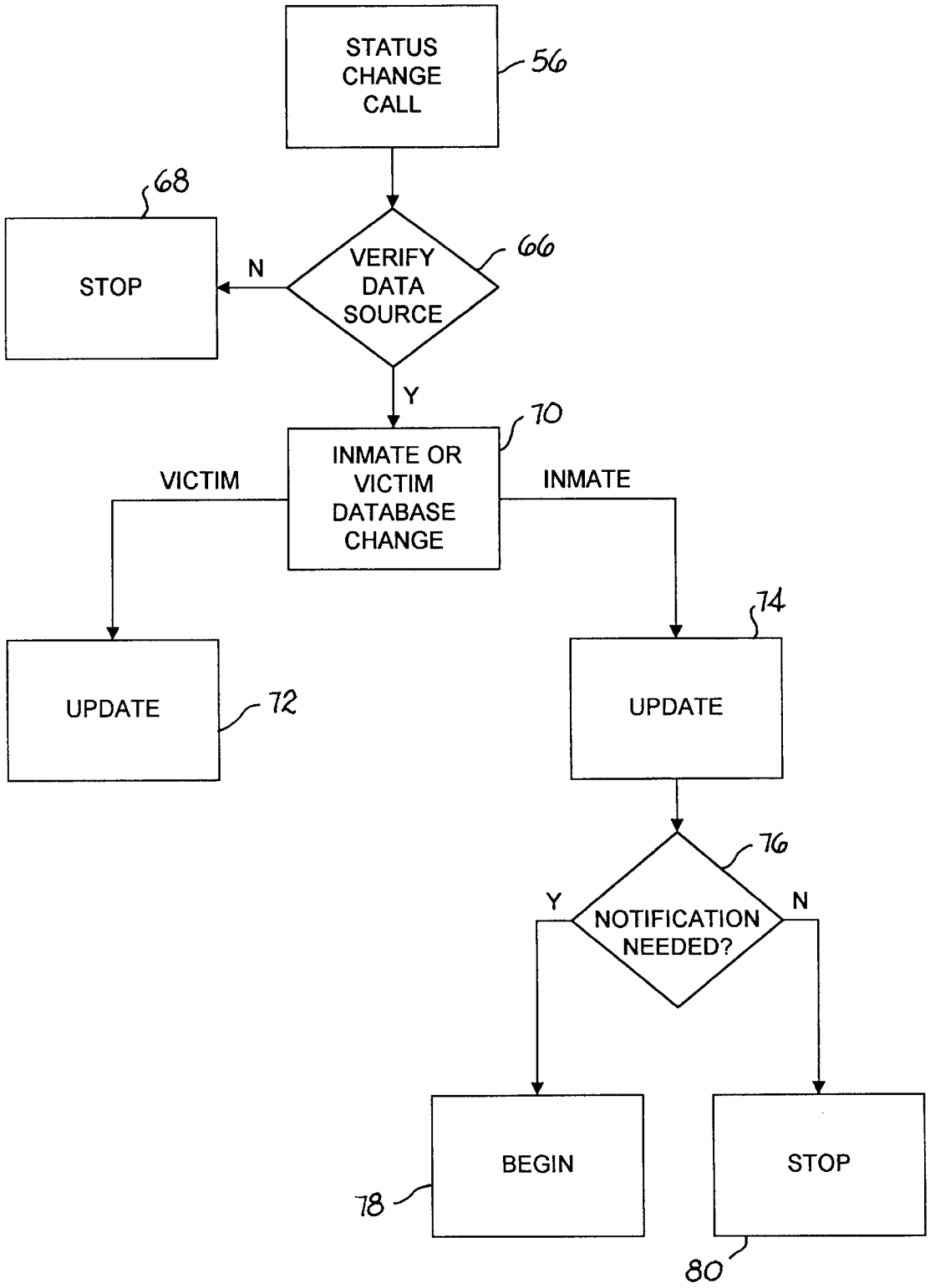
FIG. 6 is a flow chart in block diagram form depicting the main operating program used with the present invention.

The function block diagram of FIG. 6 describes the "updating" of the various files upon receipt of an incoming status change call 56 from remote gateway 12. Initially, control station 14 handshakes with the calling remote gateway 12 and verifies at VERIFY 66 that the data is coming from a legitimate source using a predetermined identifying protocol. This, of course, is needed to ensure that system is not compromised by entry of incorrect data from extraneous sources. Thus, if NO, the program routine stops at BLOCK 68. If YES, the System determines at BLOCK 70 whether this is a change to the victim or inmate database. If it is a change to the victim database, the victim database is updated at BLOCK 72. If the change is to the inmate database, then the inmate database is updated at BLOCK 74 and a determination made at NOTIFICATION 76 whether a Registered Victim associated with the particular inmate should be notified. If YES, then notification calls 78 are begun. If NO, the program ends at BLOCK 80.

Figure 7:
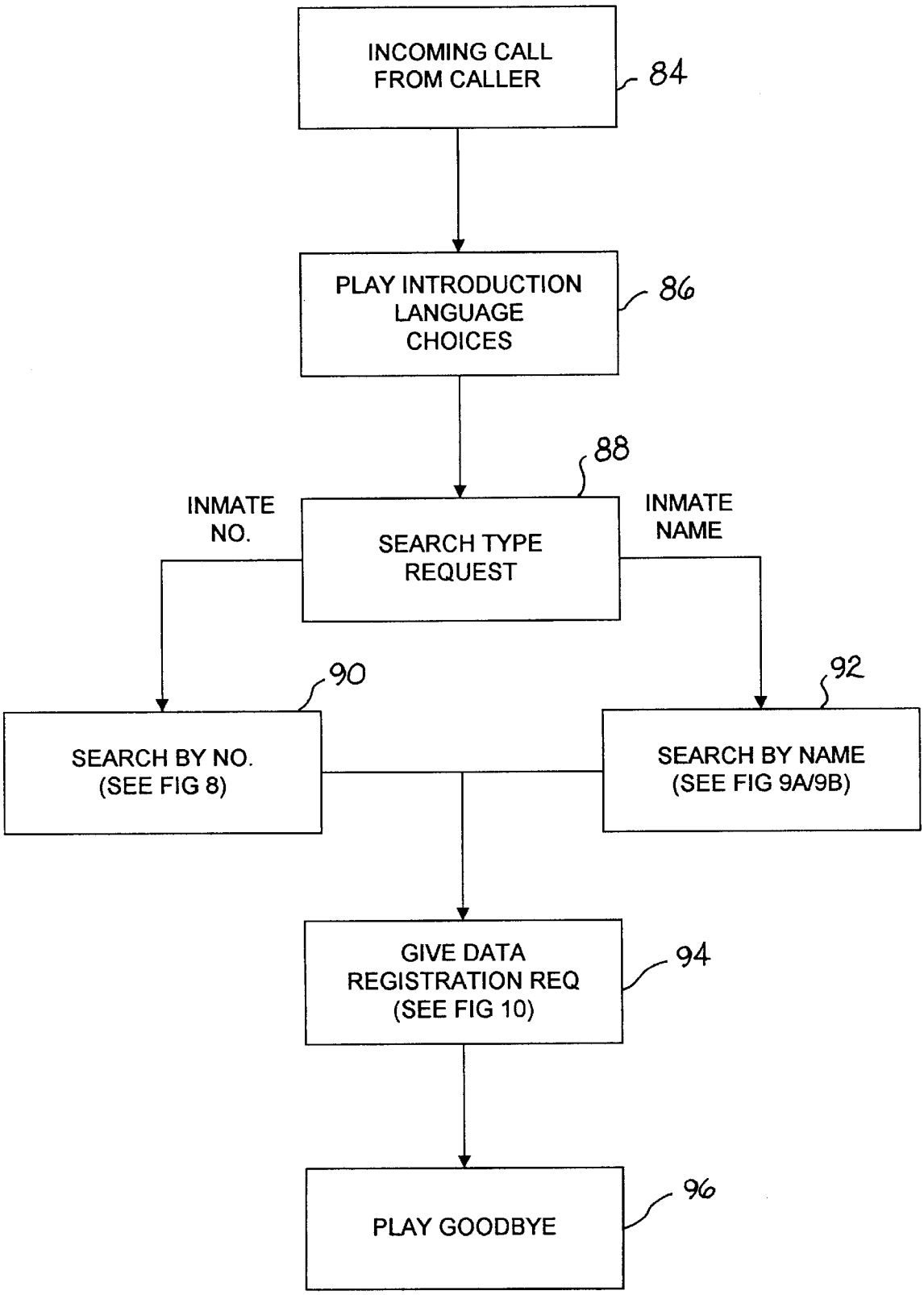
FIG. 7 is a flow chart depicting the general routine initiated by a caller for information either by inmate number or inmate name.
Figure 8:
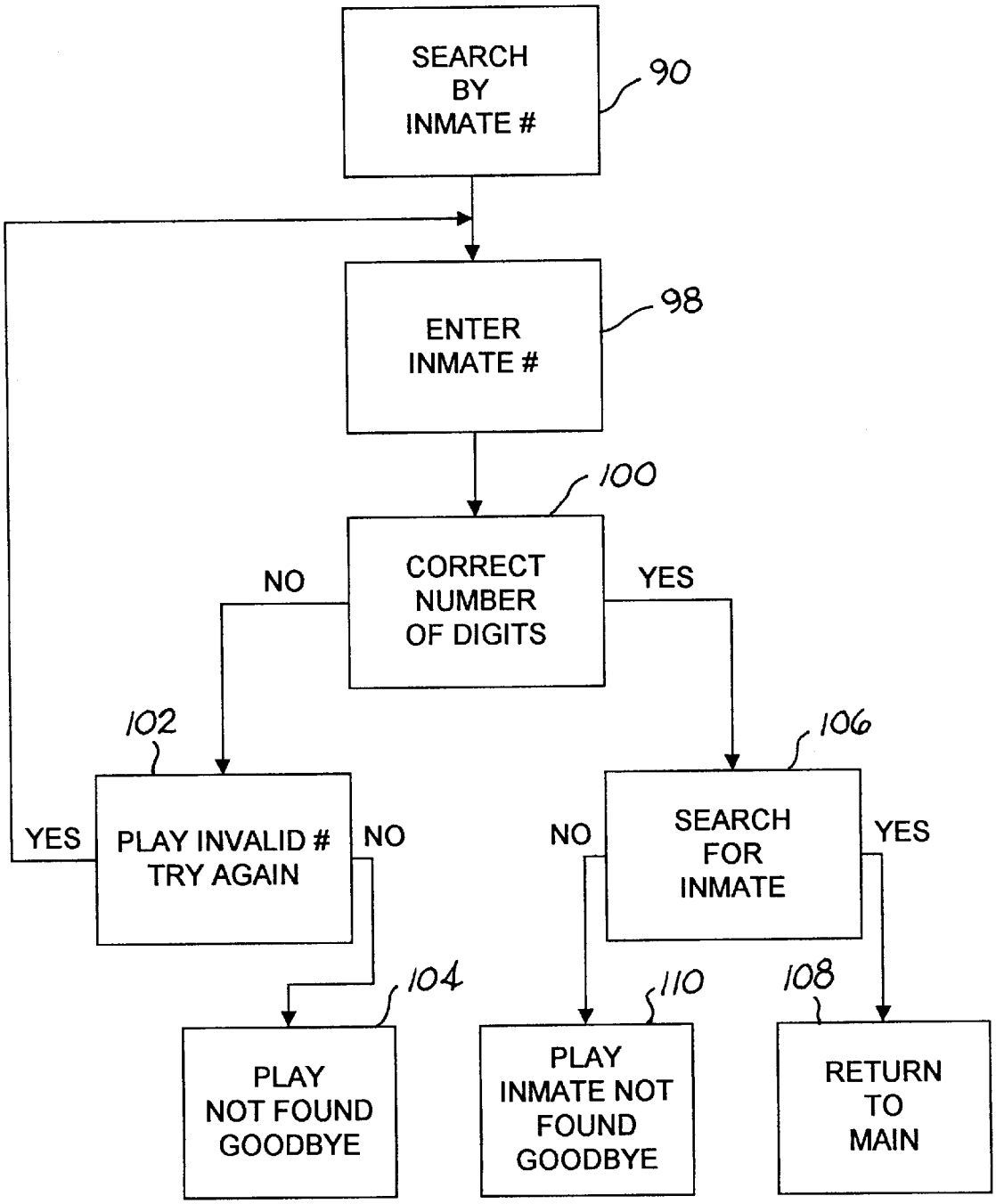
FIG. 8 is a flow chart depicting an operating program initiated by a caller when requesting a search by inmate number and the response thereto.
Figure 9A:
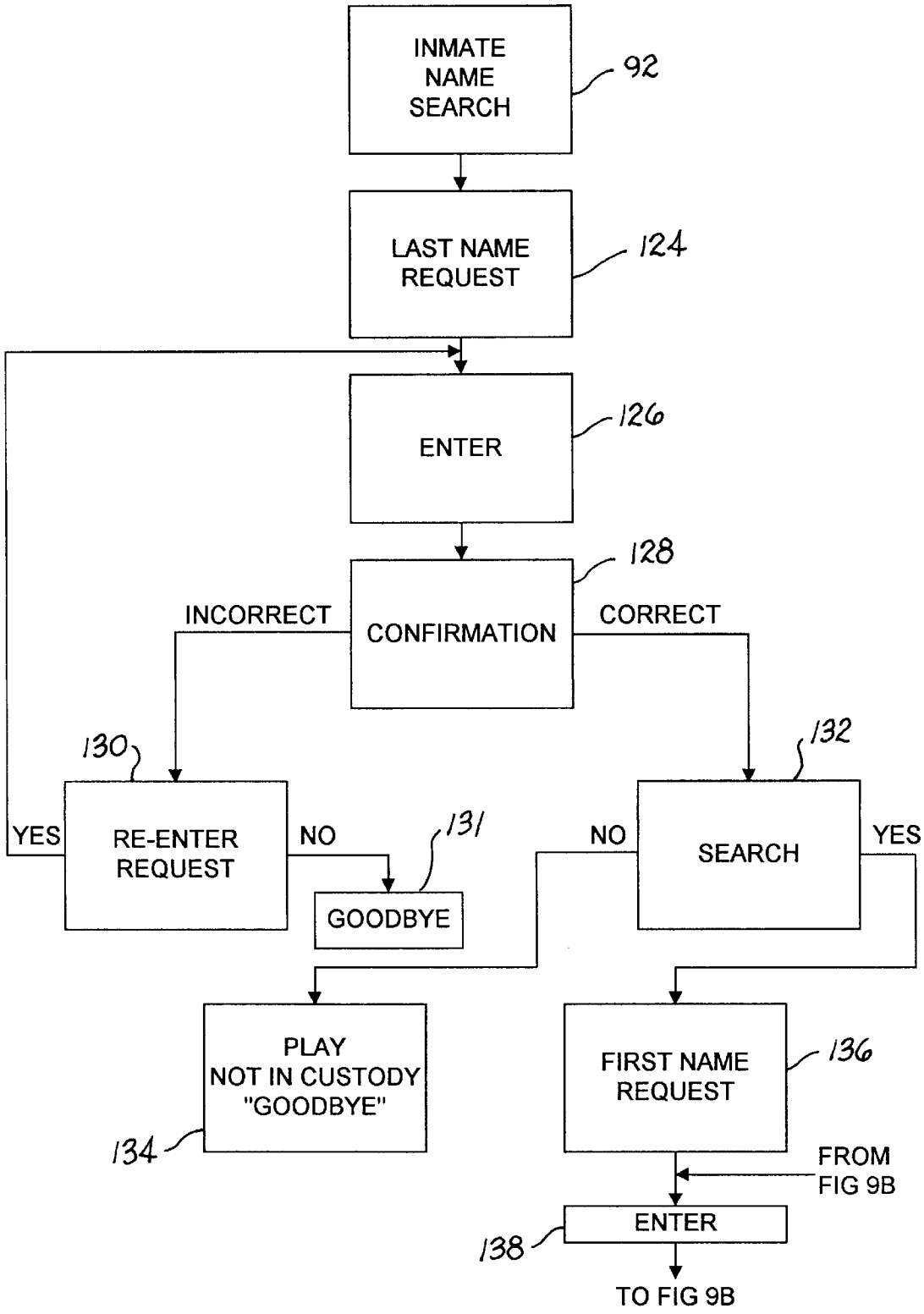
FIGS. 9A and 9B collectively represent a single flow chart depicting an operating program initiated by a caller when requesting a search by inmate name and the response thereto.
Figure 9B:
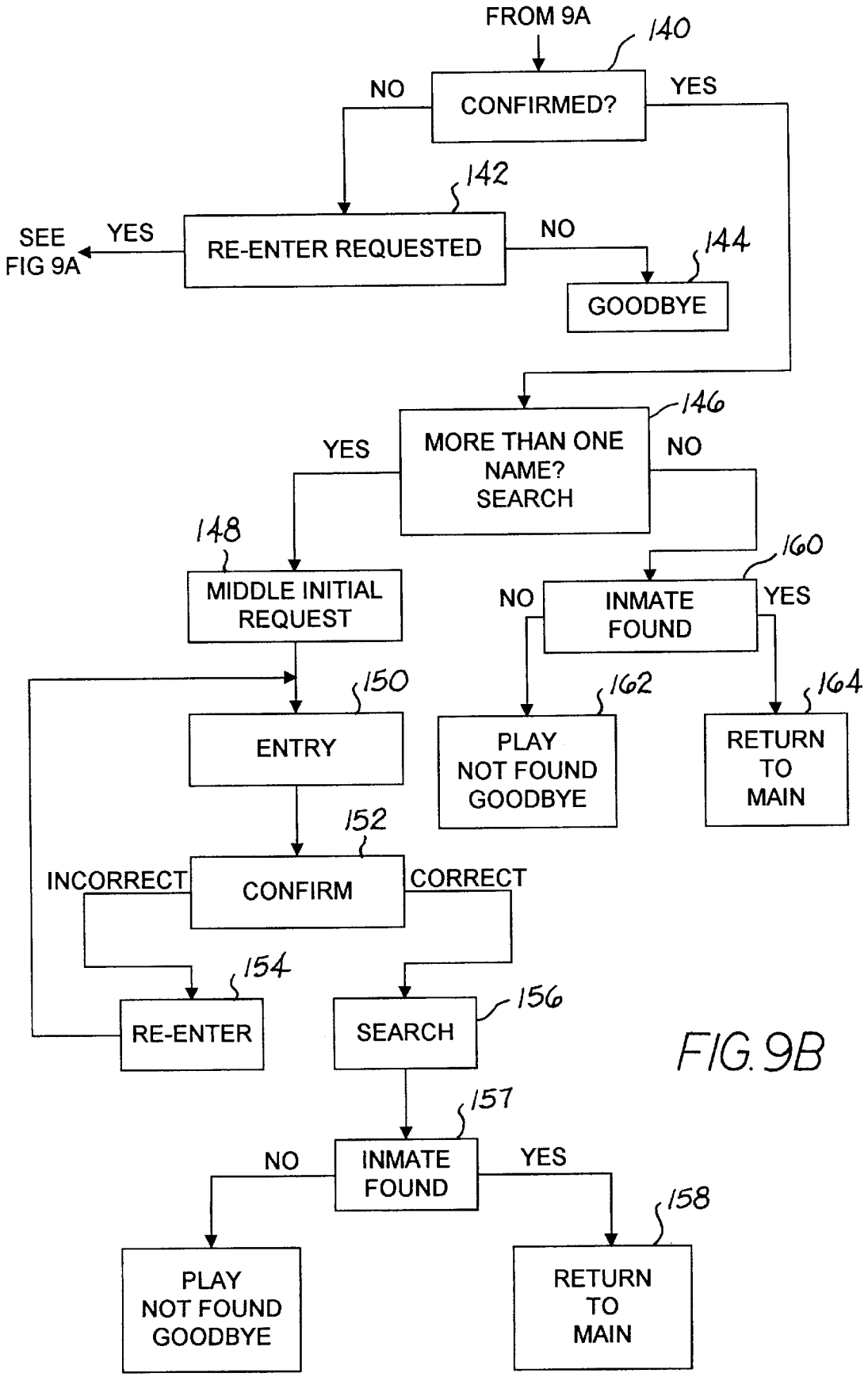
Figure 10:
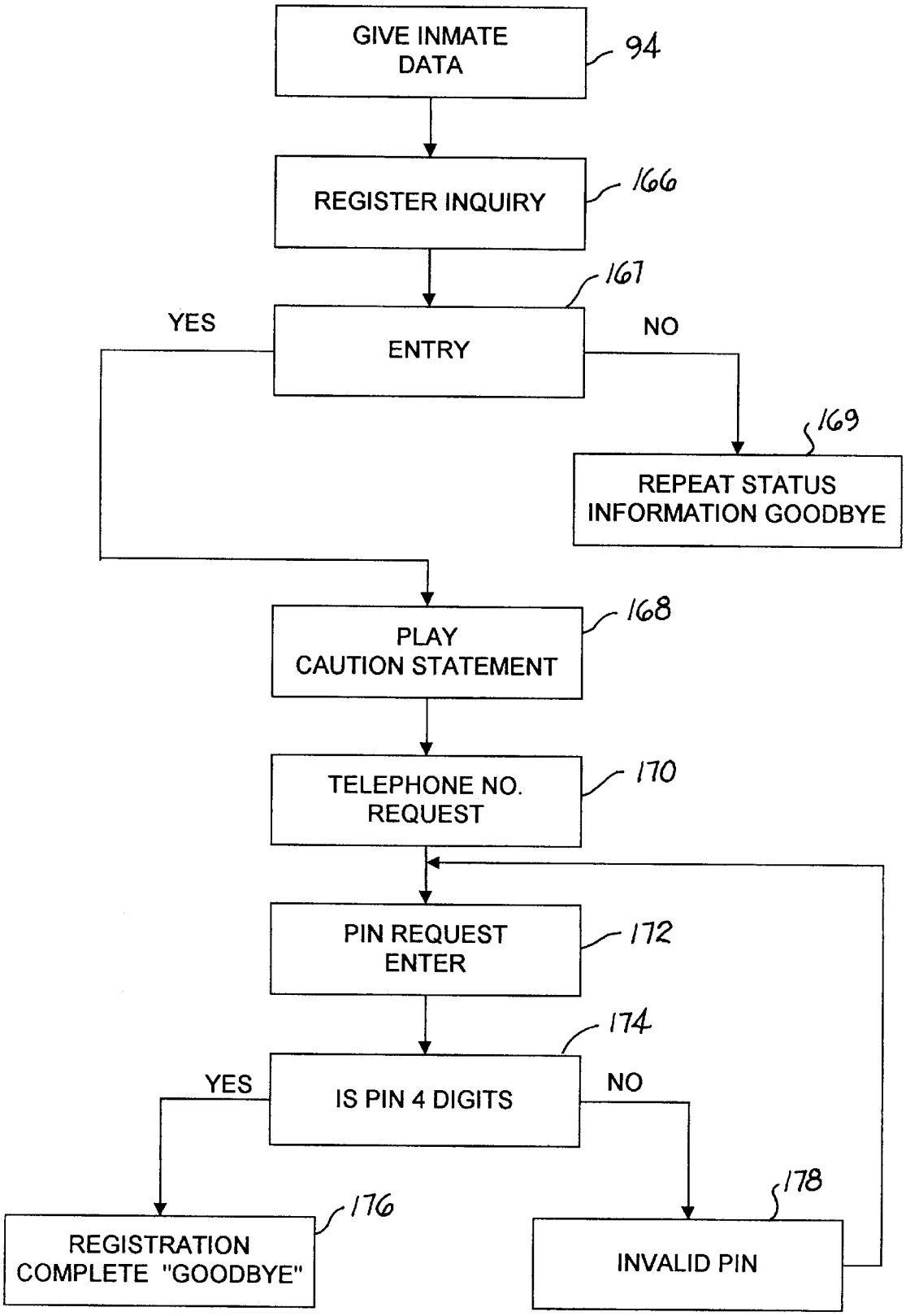
FIG. 10 is a flow chart representing an operating program initiated by a caller when registering as a to-be notified-when-status-changes-caller ("victim") into the notification system with respect to a selected inmate.

The general routine executed when a Caller dials the 800 number for a Local Site is shown in FIG. 7. The various subroutines, executed primarily in accordance with menu choices selected by the Caller, are illustrated in FIGS. 8 and 9A and 9B. FIG. 10 is the subroutine automatically executed following delivery of the requested inmate status information during which the Caller is given the option of registering as a Registered Victim.

As stated above, when the Caller calls an 800 number assigned to a Local Site at BLOCK 84, the main routine is initiated at BLOCK 86 with the control station 14 through its voice processor answering the call, identifying the Local Site associated with the call via DNIS, and providing initial prompts in accordance with the personality file for that Local Site. In multilingual localities, the initial prompts may start by giving the Caller a choice between two of more languages in which further voice communications can proceed. For example, the language choices may be English, Spanish or Vietnamese, with the voice processor stating each choice in the respective language for that choice. The Caller would press 1, 2, or 3 as prompted depending on the language choice. Once a language has been selected, the System will continue to use that language when addressing the Caller, in both current and future notification calls. The next prompt at BLOCK 88 made in the selected language would be a request to press 1 if the Caller wishes to use an "inmate number" to initiate the search or press 2 if the Caller will use the inmate name for the search. Local Authorities typically assign each inmate a number, i.e., the "inmate number", for use in the System. Then Caller then makes a choice selection depicted by BLOCK 90 for inmate number or BLOCK 92 for inmate name. The selection then initiates either the subroutines set forth in FIGS. 8 for inmate number or FIGS. 9A/9B for inmate name. Once those subroutines have been completed with the inmate information being vocally given, the Caller is returned to the main routine and will be typically asked if he or she wishes to be registered as a Registered Victim at BLOCK 94. If the Caller responds in the affirmative to the registration inquiry prompt at BLOCK 94, then the subroutine of FIG. 10 is initiated and executed. Upon completion of the registration menu selections, the program ends in the main routine with a "Goodbye" BLOCK 96 to the caller.

When the Caller elects to search for inmate status information by inmate number as illustrated in the subroutine flow chart of FIG. 8, the caller is prompted at prompt BLOCK 98 by the voice processor to enter the inmate number or, in an alternate subroutine, a "victim number" on the touch dial phone. Since the inmate number is determined by the Local Authorities, the Caller obtains the inmate number through procedures established by the Local Authorities. For certain Local Sites, the Authorities may desire to further limit access to the information imparted by the System. Some Local Authorities prefer not to permit use of the inmate names to gain access and limit dissemination of the inmates number on a need-to-know basis. Some Local Authorities issue the inmate numbers only to Registered Victims. Thus, any Caller wishing to access the System using the Local Site DNIS number would have to either register as a Registered Victim with the Local Authorities to obtain the inmate number or go through some sort of prescribed administrative procedure. Moreover, the Local Authorities may require that each Registered Victim be provided a victim notification card identification number (Victim Number) that must be entered before any information on inmates is communicated by the central control station. When the Local Site requires the use of a Victim Number, entry of a valid Victim Number will automatically call up the database for the inmate associated with the Victim Number and Registered Victim.

Once the inmate number is entered in subroutine of FIG. 8 at BLOCK 98, as prompted, control station 14 determines if the number is valid or not at determination BLOCK 100. If NO, the Caller is informed that the inmate number is not the correct number of digits at BLOCK 102 and invited to try another number or hangup. If YES, the Caller is returned to Enter Number at BLOCK 98. If No, the caller is returned to the main routine at BLOCK 104 for "Goodbye". If the inmate number has the correct number of digits at BLOCK 100 or YES, a search is made for the inmate database at BLOCK 106. If the number corresponds to an inmate in custody or YES, the Caller is returned at BLOCK 108 to the main routine at BLOCK 94 where the Caller is informed of the latest status of the inmate. If NO, i.e., no inmate is found at BLOCK 110, then the Caller is informed of this fact and the routine ends with "Goodbye".

Figure 8A:
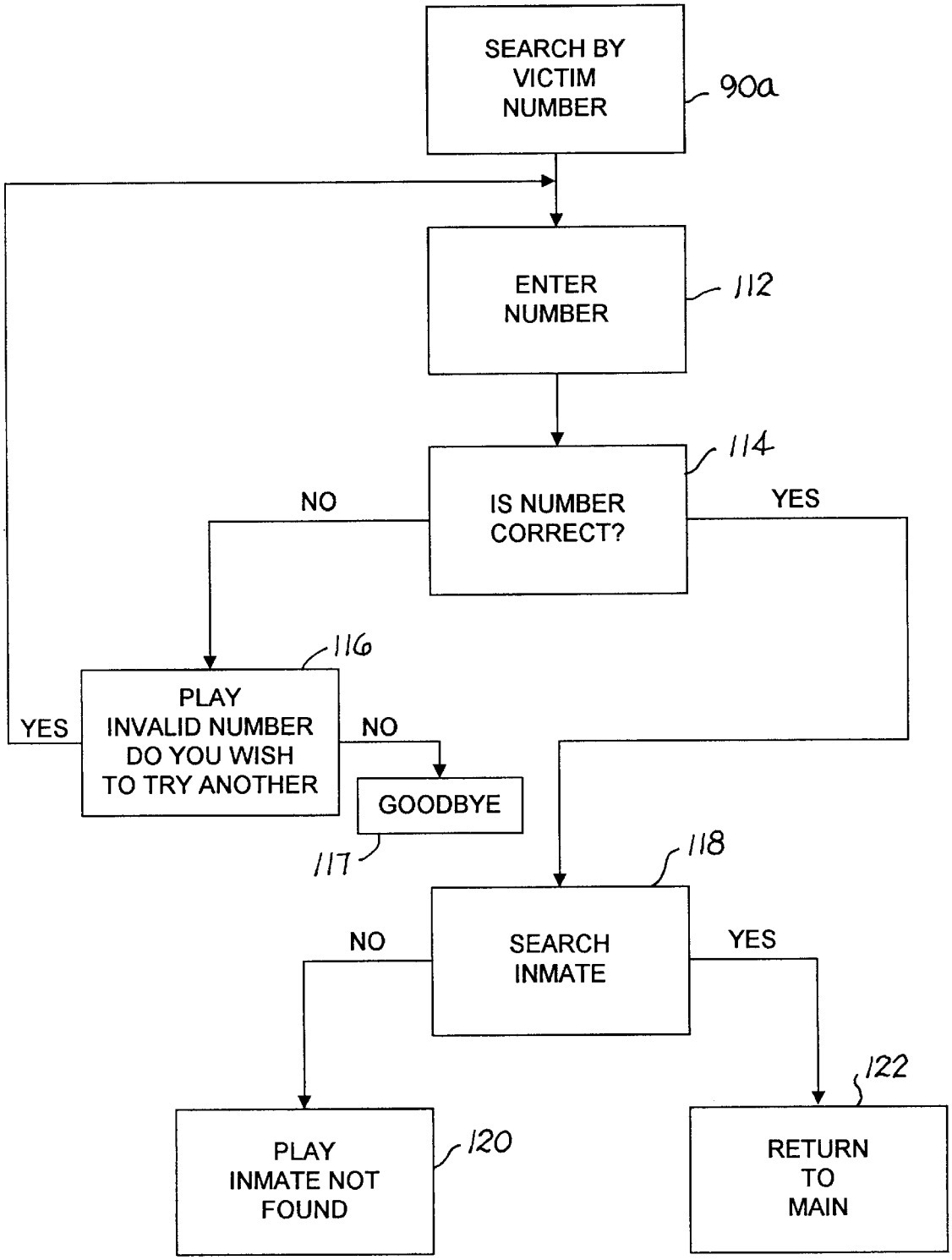
FIG. 8A is a flow chart of an alternate routine from that shown in FIG. 8 in which the caller is required to have a specific unique number in order to gain information about the status of an inmate.

Similarly, in an alternate subroutine set forth in FIG. 8A where Victim Numbers are required, once the Victim Number is entered at BLOCK 112, control station determines if the Victim Number is valid or not at BLOCK 114. If NO, the Caller is informed the number is not valid and invited to re-enter the correct Victim Number at BLOCK 116. The cycle will be repeated at predetermined number of intervals, e.g., three times, after which the control station will return to the main program at the "Goodbye" statement. If YES, the control station will search for the corresponding inmate data base at BLOCK 118. If the inmate is not found or NO, the Caller is told this at BLOCK 120 and the routine ends with "Goodbye". If the corresponding inmate database is found or YES, the control station returns to the main routine at BLOCK 122 and provided the inmate status at BLOCK 94.

Reference is now made to FIGS. 9A and 9B setting forth the subroutine executed when the Caller elects to search for inmate status information by inmate name at BLOCK 92. When such an election has been made, the control station 14 at BLOCK 124 requests that the Caller enter the inmate's last name. Typically, the Caller enters the last name at BLOCK 126 by spelling the name through use of the appropriate alphanumeric buttons on an available touch tone phone. Where the Local Authorities desire a voice responsive System, control station 14 has the additional capability of accepting voice spelling of the names through the voice recognition component 14*c* (see FIG. 1A). In either case, for confirmation, the control station 14 will generally spell back the name for the Caller at BLOCK 128 to confirm the correct entry of the name. An alternate version has the control station stating or pronouncing the name for confirmation when the name is "recognized" by the control station, i.e., where a voice file for that spelling is in the control station database.

The response to the confirmation request BLOCK 128 is to press 1 (CORRECT) or 2 (INCORRECT). If the name is incorrect, the Caller will be invited to re-enter the last name at BLOCK 130. Assuming the name is correctly spelled, the computer makes a determination at BLOCK 132 whether or not there is an inmate of that name in the database. If NO, the response of voice control station at BLOCK 134 is that the information entered is either incorrect or that no inmate of that name is in custody and the routine ends with "Goodbye". If a match is made to an inmate name or YES, the control station will next ask for the spelling of the first name of the inmate at BLOCK 136. Entry of the first name is made as stated above with respect to the last name at BLOCK 138. Again, a confirmation prompt will be executed at BLOCK 140 with an INCORRECT name entry by the Caller prompting the request for re-entry at BLOCK 142. If no re-entry is made, then "Goodbye" is played at BLOCK 144. If the entry is CORRECT, a search is made at BLOCK 146 for inmates having the same name. If two inmates of the same name are identified at BLOCK 146 or YES, a subroutine identical to the subroutines for the last and first names is executed for the inmate's middle initial with middle initial request made at BLOCK 148, entry at BLOCK 150, confirmation at BLOCK 152, and re-entry if INCORRECT at BLOCK 154. If CORRECT, this subroutine then searches for inmates at BLOCK 156. If an inmate is found or YES, the subroutine returns at BLOCK 158 to the main routine at BLOCK 94 (FIG. 7) where the Caller is provided with inmate status information. If no inmates with duplicate names are found or NO at BLOCK 146, then an inmate name search is initiated at BLOCK 160. If no inmates with that name are found or NO, then the routine ends at BLOCK 162 with the statement that no inmate of that name was found and "Goodbye". If an inmate is identified then the subroutine returns at BLOCK 164 to the main routine at BLOCK 94 where the Caller is provided with inmate status information.

FIG. 10 illustrates the subroutine executed once the System has provided the relevant inmate status information. At function BLOCK 94, control station 14 asks the Caller if he or she wishes to register in order that the Caller be notified if the status of the inmate should change. Entry is at BLOCK 167. The Caller is asked to press 1 or YES at BLOCK 166 for registration and any other key if NO. Pressing any other key results in a single repeat of the inmate status report and the routine ends with a "Goodbye" at BLOCK 169. The Caller also has the option of hanging up immediately after obtaining the status information. If YES, information is provided in this sequence as to how registration can be accomplished. Additionally, the System may state a cautionary warning at BLOCK 168 to the effect that the System is provided as a service by the Authority and that the Caller/Registered Victim should not depend solely on the System for protection and that cautionary measures should always be taken as if the inmate had already been released.

Following the cautionary note, the System next asks for the Caller (now the Registered Victim) to input a telephone number at BLOCK 170 for registration of a telephone number that the System will call when relevant inmate change of status, i.e., releases or relocations, occurs. Registration takes place in the language that the Registered Victim, then a Caller, initially selected for status change information. Typically, the System requests the Registered Victim not to register telephone numbers that go into a switch board unless prior arrangements have been made to have messages sent by the System to be confirmed and given to the Registered Victim. Following registration of the telephone number, the System then requests at BLOCK 172 for the Registered Victim to select and enter a predetermined number of digits, e.g., four, as a PIN code. At this point, the System will inform the Registered Victim that the PIN code is a personal identification number that the System will use to confirm that the Registered Victim has been notified and, upon entry by the Registered Victim, will cause the System to stop calling the registered number. The PIN number does not have to be a number unique to the Registered Victim but is required to be a string of numbers of a predetermined length (typically four) selected by the Registered Victim. If the entered string at BLOCK contains the correct string length as determined at function BLOCK 174 or YES, the System will inform the Registered Victim at BLOCK 176 that registration is completed with respect to the subject inmate, cautioning the Registered Victim to place the PIN number in a convenient location and end the routine with "Goodbye". If the System determines the number of digits of the proposed PIN number is not the predetermined number or NO, then System will announce at BLOCK 178 that the selected PIN is invalid and the subroutine will start again at the BLOCK 172, advising the Registered Victim that the selected PIN code must have the proper number of digits.

Figure 11:
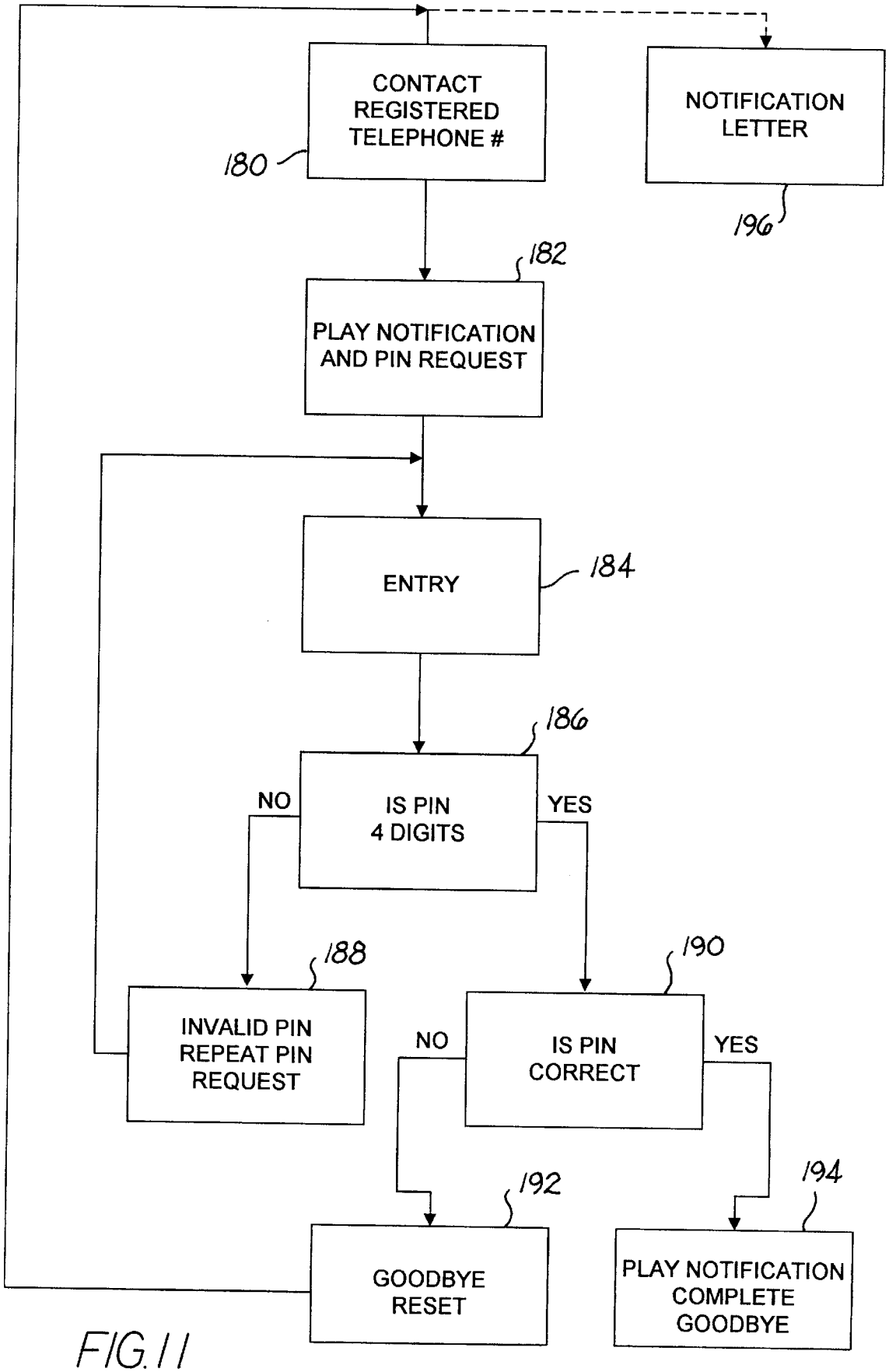
FIG. 11 is a flow chart representing an operating program initiated by system to notify a victim when the status of the selected inmate has changed.

The flow chart of FIG. 11 is a typical routine followed by the System once information flows to Control station 14 from Remote Gate 12 that the status of a particular inmate has changed. The System then searches for any Registered Victim that has registered for notification for that particular inmate and whether notification is proper for the particular status change. Once a Registered Victim has been identified, the System dials the telephone number registered for that Registered Victim in BLOCK 180 and, upon, making contact, provides a message in function BLOCK 182 appropriate for the status change such as, for example, "Pleased be advised that (inmate's name) is no longer in custody as of (date). If you wish to stop the System from calling you back, please enter your four digit PIN code that you registered on the System".

The Registered Victim (or designee) then enters the PIN code in as entry function BLOCK 184. The System then makes the determination at BLOCK 186 whether or not the PIN code is the proper number of digits and, if NO, requests the re-entry of the PIN code in BLOCK 188. If the PIN number is again re-entered improperly, the System then hangs up and resets a timer for redialing the telephone number of the Registered Victim after a predetermined time interval has lapsed such, as for, example, 10 minutes. If YES, then the System determines whether the PIN entered matches the one registered in BLOCK 190. If NO, the System states in BLOCK 192 that is not the correct PIN code, hangs up, and resets the routine as above by redialing the registered phone number after the time interval has elapsed. The redialing of the Registered Victim's telephone for will continue at such intervals for a predetermined time period, for example, 12 hours. Thereafter, a notification letter (as discussed above with respect to FIG. 1) will be automatically addressed at BLOCK 196 to Registered Victim's address informing the Victim of the number of attempted notifications by telephone and setting forth the changed inmate status. However, if YES is determined at BLOCK 190, then the System states at function BLOCK 194, that the PIN code has been confirmed, notification is complete and says "Goodbye".

It can now be readily appreciated that, in light of a reading of the foregoing description and drawings, those with ordinary skill in the art will be able to make changes and modifications to the present invention without departing from the spirit or scope of the invention as defined in the following appended claims.

I claim:

1. A victim notification system for storing status information concerning a plurality of inmates, storing information pertaining to victims each associated with a respective one of said inmates, and notifying a victim upon the occurrence of a change of status of an inmate associated with said victim comprising (a) a central control station for storing a plurality of prison inmate information files each pertaining to a respective inmate and a plurality of victim information files each pertaining to a respective victim, each of said victim information files (i) being identified with a respective one of said plurality of inmates files, (ii) containing a victim identifying code, and (iii) containing a unique electronic communication victim address;

(b) a remote data storage means for receiving inmate status change information pertaining to a change of status of a specified inmate and communicating said inmate status change information to said central control station, said central control station retaining said inmate status change information in the inmate file of said specified inmate; and (c) a plurality of victim information receiving components, each component being in communication with said central control station and having one of said electronic addresses corresponding to a victim, said control station upon receiving said inmate status change information transmitting at predetermined intervals said inmate status change information to one of said components having an electronic address corresponding to a victim associated with said specified inmate.

2. The system of claim 1 in which each of said victim files contains a victim identifying code, said control station ceasing transmission of said inmate status change information to said one component when said one component transmits to said control station a victim information signal corresponding to the victim identifying code contained in the victim file identified with the file of said specified inmate.

3. The system of claim 2 in which said control station ceases transmitting said inmate status change information when a predetermined time period elapses following an initial transmission of said inmate status change information to said one component.

4. The system of claim 1 in which said each of the victim information components is a telephone in communication with said central processing means over a long distance carrier and said inmate status change information is transmitted orally to said one component.

5. The system of claim 4 in which said victim identifying information signal is generated when said victim identifying code is entered into said long distance carrier through said telephone.

6. The system of claim 1 including storage and data entry means for generating said inmate status change information and communicating said inmate status change information to said remote data storage means.

7. The system of claim 6 in which said remote data storage means continuously polls said data storage and data means for inmate status change information.

8. The system of claim 1 in which said remote data storage means sends a communication signal to said central control station at predetermined time intervals thereby notifying said central control station that said remote data storage means is in working order.

9. The system of claim 8 including a pager worn by a system operator, said pager in communication with said central control station and alerting the operator when said communication signal is not received by said central control station following said predetermined time period.

10. The system of claim 8 including an alarm in communication with said central control station, said central control station generating an alarm signal in the event that said communication signal is not received by said central control station following said predetermined time interval.

11. The system of claim 1 including a plurality of remote data storage means each associated with a respective one of a plurality of data entry and storage means, each of said data entry and storage means for storing information pertaining to a select group of inmates and for generating said inmate status change information, each of said remote data storage means communicating with an periodically uploading inmate status change information generated by said associated data entry and storage means.

12. The system of claim 11 in which each of said remote data storage means sends a communication signal to said central control station at predetermined time intervals thereby notifying said central control station that said remote data storage means sending said communication signal is in working order.

13. The system of claim 12 in which at least some of said plurality of said remote data storage means send respective communication signals at predetermined time intervals over a unique and separate communication channel typing each of said some of said plurality of remote data storage means to said control station, said central control station determining an identity of a remove data storage means communicating with said central control station from the unique communication channel.

14. The system of claim 12 in which at least some of said plurality of said remote data storage means periodically transmit said communication signal over a communication line supporting the transmission of unique signals along with said communication signal, each of said unique signals being associated with a respective one of said some of said remote data storage means, said central control station determining an identity of a remote storage means sending said communication signal by the unique signal being transmitted therewith.

15. An inmate status information system for storing status and change of status information pertaining to each of a plurality of inmates and providing said information upon a request from a caller pertaining to the status of a selected one of said inmates comprising (a) a central control station for storing a plurality of prison inmate information files each pertaining to a respective inmate;

(b) a remote data storage means for receiving inmate status information and communicating said status change information to said central control station pertaining to said inmates, said central control station retaining status information in said information files;

(c) a communication transmission component; and (d) a communication channel selectively and electronically tying said component and said central control station together, said central control station responsive to a request signal generated by one of said components for providing status information pertaining to a selected inmate to said one component.

16. The system of claim 15 in which each of said files of said inmates contains an inmate identifying code, said component for generating and inputting an identifying signal corresponding to said code into said communication channel upon receipt of a inmate identifying request signal from said control station thereby selecting said selected inmate, said control station upon receipt of said identifying signal transmitting an information status signal containing said status information pertaining to said selected inmate to said component.

17. The system of claim 15 including a plurality of inmate status information input devices each associated with a set of said plurality of inmates for generating said status and change of status information for respective sets of inmates, a plurality of remote storage devices each associated with a respective input device for providing status and status change information of inmates in said associated set to said central control station, and a plurality of unique communication channels each associated with a respective one of said remote storage devices, said communication transmission component selecting one of said communication channels for transmitting said status request signal to said control station.

18. The system of claim 17 wherein said central station stores a plurality of personality files each associated with a respective communication channel, said personality files each executing unique communication routines with said component when chosen by said central station, said central station choosing one of said personality files associated with said one channel when said component and said central station are in communication over said one channel.

19. The system of claim 15 in which said control station generates a registration request signal following transmission of said information status signal to said communication transmission component, said control station in response to receipt of an registration input signal containing an electronic address of said component and an identifying code storing said information pertaining to said electronic address and said identifying code and associating said information with said selected inmate, said control station thereafter transmitting an inmate status information signal containing status information to said electronic address upon receipt of status information pertaining to said selected inmate.

20. The system of claim 15 including an input data device for generating said inmate status and change of information, said input devices further adapted to generate input victim registration information pertaining to an individual who wishes to be notified upon the change of status of a specified inmate, said registration information including an electronic address of the individual and an identifying code, said remote storage device storing said victim information and transmitting a victim information signal pertaining to said victim registration information to said central control station whereupon said control station stores said victim registration information in a victim file associated with said specified inmate, said control station transmitting a change of status information signal to said electronic address upon receipt of any subsequent change of status information signal from said remote storage means pertaining to said specified inmate.

21. The system of claim 19 in which said control station ceases transmitting said change of status information signal to said electronic address when said component transmits and said control station receives a code signal containing said identifying code.

22. The system of claim 19 in which said control station ceases transmitting said change of status information signal to said electronic address when a predetermined time period elapses following an initial transmission of said change of status information signal.

23. A method for communicating change of status information of a prison inmate to a victim registered to be notified upon the occurrence of said change of status and confirming that a communication of said change of status information has been received by said victim comprising the steps of (a) inputting into and storing first information pertaining to said prison inmate, said first information being periodically updated with inmate status change information;

(b) storing second information pertaining to said registered victim, said second information including an electronic address of said registered victim and a victim code pertaining to said registered victim;

(c) monitoring said first information for inmate status change information;

(d) upon the occurrence of said inmate status change information, searching said second information for said electronic address;

(e) contacting said electronic address at spaced predetermined time intervals with a notification that includes said inmate status change information until an earliest occurrence of (i) a receipt of a transmission that includes said victim code, said step of contacting ceasing upon receipt of said transmission, thereby indicating said registered victim has received said notification or (ii) a predetermined time period elapses from a point in time when said step of contacting was initiated, said step of contacting ceasing upon the completion of said time period thereby indicating said registered victim has not received said notification.

24. The method of claim 23 including a step of transmitting said first information including said inmate status change information to a central station, said second information being stored at said central station, said steps of monitoring and contacting being made at said central station, and said transmission being made to said central station.

25. The method of claim 24 in which said sets of first information respectively pertaining to prison inmates imprisoned at various prisons are respectively stored at respective information storage and retrieval sites and electronic addresses of a plurality of registered victims each associated with respective prison inmates are stored at said central station.

26. The method of claim 23 in which a plurality of victims are registered to be notified upon the occurrence of a change of status information of said inmate, each of said registered victims having a respective electronic address and a victim code, each of said registered victims being contacted at said respective electronic address until the earliest occurrence of the receipt of said transmission with said respective victim code or until the predetermined time period elapses.

27. The method of claim 23 in which the registered victim following an expiration of the predetermined time period is automatically notified in writing with the change of status information.

28. The method of claim 25 in which a unique communication channel separate from a communication channel over which said step of contacting is conducted is assigned to said central station for each set of inmates, said central station providing said inmate status change information pertaining to a specified inmate only when a caller correctly selects one of said unique communication channels pertaining to a set of inmates that includes said specified inmate and identifies said specified inmate using said selected unique channel.

29. The method of claim 25 including a set of unique communication channels with said central station for each set of inmates, said central station storing a set of personality files each associated with a respective channel, said personality files each adapted to executing unique communication routines when chosen by said central station, said central station in response to a communication being established over one of said channels choosing a personality file associated with said one channel thereby causing said chosen personality file to execute its communication routine.

30. The method of claim 28 in which said caller identifies said specified inmate by transmitting an inmate number unique to said specified inmate over said specified communication channel to said central station.

31. The method of claim 30 in which said caller identifies said specified inmate by transmitting an inmate name of said specified inmate over said specified communication channel to said control center.

32. The method of claim 25 in which said second information is first inputted into said respective remote storage and retrieval site and then transmitted to said central station.

33. The method of claim 32 including a set of inmate information gathering stations each associated with a respective set of groups of inmates and in respective communication with a respective one of said sets of remote storage and retrieval sites, said gathering stations information storage and retrieval sites transmitting said sets of first information to said remote stations.

34. The method of claim 33 in which each of said remote information storage and retrieval sites continually monitors a respective gathering station for changes in inmate status of said associated set of inmates and transmits said changes to said central station.

35. The method of claim 25 in which a separate communication channel is provided to said central station for each set of inmates, said central station providing said inmate status change information pertaining to a specified inmate to a caller identifying said specified inmate and using a specified one of said channels, said caller inputting said second information into said central station using said specified one of said channels thereby become one of said registered victims for a subsequent notification upon the occurrence of further inmate status change information for said specified inmate.

36. The method of claim 25 in which said remote sites send a communication to said control station at predetermined time intervals, said control station transmitting an alerting signal when one of said remote sites fails to send said communication at said predetermined time interval.

37. The method of claim 36 in which at least part of said remote sites transmit said communication to said central station over a separate communication channel thereby permitting said central station to identify the transmitting remote site by the channel transmitting the communication.

38. The method of claim 36 in which at least part of said remote sites transmit said communication to said central station over a common communication channel, each of said remote sites transmitting said communication accompanied by each site unique to each site thereby permitting said central station to identify the transmitting remote site by the unique signal accompanying said communication.

* * * * *

US005861810C1

(12) REEXAMINATION CERTIFICATE (4281st)

United States Patent

Nguyen

(10) Number: US 5,861,810 C1

(45) Certificate Issued: Feb. 27, 2001

(54) SYSTEM AND METHOD FOR PROVIDING CRIME VICTIMS UPDATED INFORMATION AND EMERGENCY ALERT NOTICES

(75) Inventor: Yung T. Nguyen, Louisville, KY (US)

(73) Assignee: Interactive Systems, LLC, Louisville, KY (US)

Reexamination Request:
No. 90/005,408, Jun. 29, 1999

Reexamination Certificate for:

| | |
|---|---|
| Patent No.: | **5,861,810** |
| Issued: | **Jan. 19, 1999** |
| Appl. No.: | **08/722,359** |
| Filed: | **Sep. 27, 1996** |

(51) Int. Cl.[7] ..... G08B 23/00

(52) U.S. Cl. ..... 340/573.4; 340/534; 340/825.36; 379/38; 379/39

(58) Field of Search ..... 340/573, 534, 340/825.36; 379/38, 39

(56) References Cited

U.S. PATENT DOCUMENTS 5,861,810 * 1/1999 Nguyen ..... 340/573.4

OTHER PUBLICATIONS

Nguyen et al, Bid Proposal No. P–20434, InfoTech, pp. 28–29, May 1994.*

* cited by examiner

*Primary Examiner*—Jeff Hofsass

(57) ABSTRACT

A system and method for communicating information concerning the status of inmates to callers and automatically notify victims registered with the system at a registered electronic address when the status of a specified inmate has changed. The notifications to the electronic address of the registered victim will continue at spaced predetermined intervals until either the registered victim responds with a registered personal identification number or a predetermined time period measured from the initial time notification elapses.

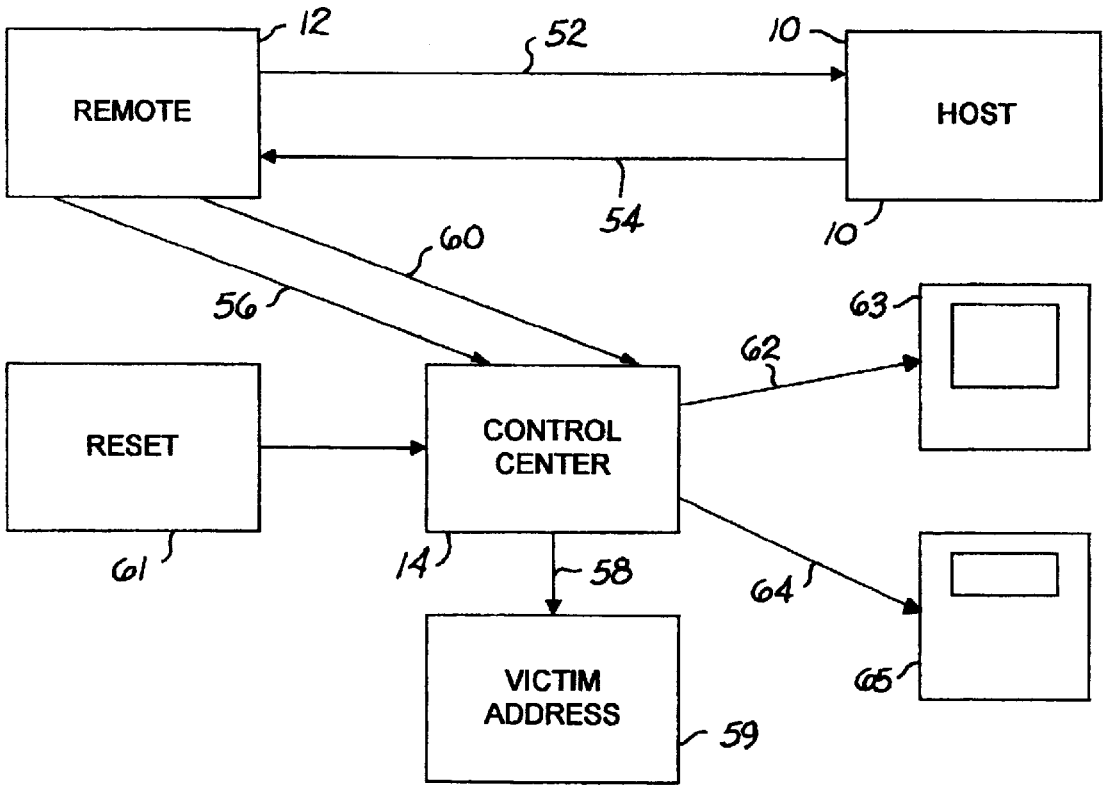

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 23 is cancelled.

Claims 1, 4, 7, 11, 13, 15–22, 24–27, 30–33 and 35–38 are determined to be patentable as amended.

Claims 2, 3, 5, 6, 8–10, 12, 14, 28, 29 and 34, dependent on an amended claim, are determined to be patentable.

1. A victim notification system for storing status information concerning a plurality of inmates, storing information pertaining to victims each associated with a respective one of said inmates, and notifying a victim upon the occurrence of a change of status of an inmate associated with said victim comprising (a) a central control station for storing a plurality of prison inmate information files each pertaining to a respective inmate and a plurality of victim information files each pertaining to a respective victim, each of said victim information files (i) being identified with a respective one of said plurality of [inmates] *inmate* files, (ii) containing a victim identifying code, and (iii) containing a unique electronic communication victim address;

(b) a remote data storage means for receiving inmate status change information pertaining to a change of status of a specified inmate and communicating said inmate status change information to said central control station, said central control station retaining said inmate status change information in the inmate file of said specified inmate; and (c) a plurality of victim information receiving components, each component being in communication with said central control station and having one of said electronic addresses corresponding to a victim, said control station upon receiving said inmate status change information transmitting at predetermined intervals said inmate status change information to one of said components having an electronic address corresponding to a victim associated with said specified inmate.

4. The system of claim [1] *2* in which said each of the victim information *receiving* components is a telephone in communication with said central [processing means] *control station* over a long distance carrier and said inmate status change information is transmitted orally to said one component.

7. The system of claim 6 in which said remote data storage means continuously polls said [data] storage and data *entry* means for inmate status change information.

11. The system of claim 1 including a plurality of remote data storage means each associated with a respective one of a plurality of data entry and storage means, each of said data entry and storage means for storing information pertaining to a select group of inmates and for generating said inmate status change information, each of said remote data storage means communicating with [an] *and* periodically uploading inmate status change information generated by said associated data entry and storage means.

13. The system of claim 12 in which at least some of said plurality of said remote data storage means send respective communication signals at predetermined time intervals over a unique and separate communication channel [typing] *tying* each of said some of said plurality of remote data storage means to said control station, said central control station determining an identity of a remove data storage means communicating with said central control station from the unique communication channel.

15. An inmate status information system for storing status and change of status information pertaining to each of a plurality of inmates and providing said information upon a request from a caller pertaining to the status of a selected one of said inmates comprising (a) a central control station for storing a plurality of prison inmate information files each pertaining to a respective inmate;

(b) a remote data storage means for receiving inmate status information and communicating said status change information to said central control station pertaining to said inmates, said central control station retaining status information in said information files;

(c) [a] *one or more* communication transmission [component] *components*; and (d) a communication channel selectively and electronically tying said component and said central control station together, said central control station responsive to a request signal generated by one of said components for providing status information pertaining to a selected inmate to said one component.

16. The system of claim 15 in which each of said files of said inmates contains an inmate identifying code, said component for generating and inputting an identifying signal corresponding to said code into said communication channel upon receipt of a inmate identifying request signal from said *central* control station thereby selecting said selected inmate, said *central* control station upon receipt of said identifying signal transmitting an information status signal containing said status information pertaining to said selected inmate to said component.

17. The system of claim 15 including a plurality of inmate status information input devices each associated with a set of said plurality of inmates for generating said status and change of status information for respective sets of inmates, a plurality of remote storage [devices] *means* each associated with a respective input device for providing status and status change information of inmates in said associated set to said central control station, and a plurality of unique communication channels each associated with a respective one of said remote storage [devices] *means*, said communication transmission component selecting one of said communication channels for transmitting said status request signal to said *central* control station.

18. The system of claim 17 wherein said central *control* station stores a plurality of personality files each associated with a respective communication channel, said personality files each executing unique communication routines with said component when chosen by said central *control* station, said central *control* station choosing one of said personality files associated with said one channel when said component and said central *control* station are in communication over said one channel.

19. The system of claim 15 in which said *central* control station generates a registration request signal following transmission of said [information status signal] *status information* to said communication transmission component, said control station in response to receipt of [an] *a* registration input signal containing an electronic address of said component and an identifying code storing said information pertaining to said electronic address and said identifying code and associating said information with said selected inmate, said *central* control station thereafter transmitting an inmate status information signal containing status information to said electronic address upon receipt of status information pertaining to said selected inmate.

20. The system of claim 15 including an input data device for generating said inmate status and change of *status* information, said input [devices] *device* further adapted to generate input victim registration information pertaining to an individual who wishes to be notified upon the change of status of a specified inmate, said *victim* registration information including an electronic address of the individual and an identifying code, said remote storage [device] *means* storing said victim *registration* information and transmitting a victim information signal pertaining to said victim registration information to said central control station whereupon said *central* control station stores said victim registration information in a victim file associated with said specified inmate, said *central* control station transmitting a change of status information signal to said electronic address upon receipt of any subsequent change of status information signal from said remote storage means pertaining to said specified inmate.

21. The system of claim 19 in which said *central* control station ceases transmitting said change of status information signal to said electronic address when said component transmits and said control station receives a code signal containing said identifying code.

22. The system of claim 19 in which said *central* control station ceases transmitting said change of status information signal to said electronic address when a predetermined time period elapses following an initial transmission of said change of status information signal.

24. [The method of claim 23 including a step of] *A method for communicating change of status information of a prison inmate to a victim registered to be notified upon the occurrence of said status change and confirming that a communication of said status change information has been received by said registered victim comprising the steps of*

(*a*) *inputting into and storing first information pertaining to said prision inmate, said first information being periodically updated with inmate status change information;*

(*b*) transmitting said first information including said inmate status change information to a central station[,]*;*

(*c*) *storing second information pertaining to said registered victim* [said second information being stored] at said central station, *said second information including an electronic address of said registered victim and a victim code pertaining to said registered victim;*

(*d*) *monitoring said first information* [said steps of monitoring and contacting being made] at said central station[,] *for inmate status change information;*

(*e*) *upon the occurrence of said inmate status change information, searching said second information for said electronic address;*

(*f*) *contacting said electronic address from said central station at spaced predetermined time intervals with a notification that includes said inmate status change information until an earliest occurrence of*

(*i*) *a receipt of a transmission* [and said transmision being made to] *by* said central station *that includes said victim code, said step of contacting ceasing upon receipt of said transmission, thereby indicating said registered victim has received said notification or*

(*ii*) *a predetermined time period elapses from a point in time when said step of contacting was initiated, said step of contacting ceasing upon the completion of said time period thereby indicating said registered victim has not received said notification.*

25. The method of claim 24 in which [said] sets of first information respectively pertaining to *sets of* prison inmates imprisoned at various prisons are respectively stored at respective information storage and retrieval sites, and electronic addresses of a plurality of registered victims each associated with respective prison inmates are stored at said central station.

26. The method of claim [23] *24* in which a plurality of victims are registered to be notified upon the occurrence of [a change of status information] *the status change* of said inmate, each of said registered victims having a respective electronic address and a victim code, each of said registered victims being contacted at said respective electronic address until the earliest occurrence of the receipt of said transmission with said respective victim code or until the predetermined time period elapses.

27. The method of claim [23] *24* in which the registered victim following an expiration of the predetermined time period is automatically notified in writing with the *status* change [of status] information.

30. The method of claim 28 in which said caller identifies said specified inmate by transmitting an inmate number unique to said specified inmate over said [specified] *selected unique* communication channel to said central station.

31. The method of claim 30 in which said caller identifies said specified inmate by transmitting an inmate name of said specified inmate over said [specified] *selected unique* communication channel to said [control center] *central station*.

32. The method of claim 25 in which said second information is first inputted into said respective remote storage and retrieval [site] *sites* and then transmitted to said central station.

33. The method of claim 32 including a set of inmate information gathering stations each associated with a respective set of [groups of] *prison* inmates and in respective communication with a respective one of said [sets of] remote storage and retrieval sites, said gathering stations [information storage and retrieval sites] transmitting said sets of first information to said remote [stations] *storage and retrieval sites*.

35. The method of claim 25 in which a separate communication channel is provided to said central station for each set of inmates, said central station providing said inmate status change information pertaining to a specified inmate to a caller identifying said specified inmate and using a specified one of said channels, said caller inputting said second information into said central station using said specified one of said channels thereby [become] *becoming* one of said registered victims for a subsequent notification upon the occurrence of further inmate status change information for said specified inmate.

36. The method of claim 25 in which said remote *storage and retrieval* sites send a communication to said [control]

*central* station at predetermined time intervals, said [control] *central* station transmitting an alerting signal when one of said remote *storage and retrieval* sites fails to send said communication at said predetermined time interval.

37. The method of claim 36 in which at least part of said remote *storage and retrieval* sites transmit said communication to said central station over a separate communication channel thereby permitting said central station to identify the transmitting remote *storage and retrieval* site by the channel transmitting the communication.

38. The method of claim 36 in which at least part of said remote *storage and retrieval* sites transmit said communication to said central station over a common communication channel, each of said remote *storage and retrieval* sites transmitting said communication accompanied by each site unique to each site thereby permitting said central station to identify the transmitting remote *storage and retrieval* site by the unique signal accompanying said communication.

* * * * *